US010626560B2

(12) United States Patent
Johnston

(10) Patent No.: US 10,626,560 B2
(45) Date of Patent: Apr. 21, 2020

(54) MAGNETIC INDUCTIVE RAIL HEATING HEAD

(71) Applicant: Jeffrey Ross Johnston, Jacksonville, FL (US)

(72) Inventor: Jeffrey Ross Johnston, Jacksonville, FL (US)

( * ) Notice: Subject to any disclaimer, the term of this patent is extended or adjusted under 35 U.S.C. 154(b) by 313 days.

(21) Appl. No.: 15/834,038

(22) Filed: Dec. 6, 2017

(65) Prior Publication Data

US 2018/0155879 A1 Jun. 7, 2018

Related U.S. Application Data

(60) Provisional application No. 62/430,460, filed on Dec. 6, 2016.

(51) Int. Cl.
*E01B 7/24* (2006.01)
*H05B 6/10* (2006.01)
*H05B 6/40* (2006.01)

(52) U.S. Cl.
CPC ..... *E01B 7/24* (2013.01); *H05B 6/101* (2013.01); *H05B 6/104* (2013.01); *H05B 6/40* (2013.01)

(58) Field of Classification Search
CPC ..... H05B 6/101; H05B 6/104; H05B 6/40; E01B 7/24
USPC ..... 219/635
See application file for complete search history.

(56) References Cited

U.S. PATENT DOCUMENTS 748,448 A * 12/1903 Whipple ..... E01B 7/24 246/428
1,477,982 A * 12/1923 Shriver ..... E01B 7/24 246/428
1,663,874 A * 3/1928 Brisson ..... E01B 7/24 219/535
1,980,916 A * 11/1934 Greenfield ..... E01B 7/24 24/510
1,991,801 A * 2/1935 Greenfield ..... E01B 7/24 246/428
2,500,399 A * 3/1950 Broome ..... E01B 7/24 219/535
2,910,567 A * 10/1959 Holstein ..... E01B 7/24 219/213
3,204,094 A * 8/1965 Huisinga ..... E01B 7/24 246/428
RE31,081 E * 11/1982 Keep, Jr. ..... E01B 7/24 104/280
4,429,845 A * 2/1984 Stover ..... E01B 7/24 104/280

(Continued)

*Primary Examiner* — Benjamin R Shaw

(57) ABSTRACT

A rail heating head includes a vented enclosure and an induction coil. The induction coil is positioned within the vented enclosure. When in use, the vented enclosure is positioned adjacent a lateral portion of a train track rail. To be positioned adjacent to the head, the web, and the foot of the train track rail, a rail-bracing wall of the vented enclosure has a convex exterior surface and a concave interior surface. The induction coil has an oblong, concave shape and is pressed against the concave interior surface. Thus, the induction coil can induce eddy current magnetic fields in the head, the web, and the foot maximizing surface area. The larger surface area results in molecules in a large area being activated and leads to more heat. An eddy current deflecting magnetic shield further directs magnetic fields towards the train track rail.

16 Claims, 5 Drawing Sheets

(56) References Cited

U.S. PATENT DOCUMENTS

| | | | | | |
|---|---|---|---|---|---|
| 5,004,190 | A * | 4/1991 | Montierth | E01B 7/24 | 104/279 |
| 5,389,766 | A * | 2/1995 | Takahashi | E01B 7/24 | 104/279 |
| 5,824,997 | A * | 10/1998 | Reichle | E01B 7/24 | 219/537 |
| 2016/0258124 | A1 * | 9/2016 | Johnston | E01H 8/08 | |

* cited by examiner

MAGNETIC INDUCTIVE RAIL HEATING HEAD

The current application claims a priority to the U.S. Provisional Patent application Ser. No. 62/430,460 filed on Dec. 6, 2016.

FIELD OF THE INVENTION

The present invention relates generally to a railway heating head. More specifically, the present invention introduces an inductive heating head that is used to heat a rail and prevent the accumulation of frozen material. The present invention enables railway operators to ensure that properly equipped rail switches will function unhindered in freezing temperatures.

BACKGROUND OF THE INVENTION

Switch tracks, used to transfer train direction from one track to another, depend on precision joints within the switch that move and transfer movement of a train to another track. In winter months, snow and ice may build up within the joints preventing the drive motors or linkages from being able to shift position. This problem is typically solved by heating the rails to melt the snow and thus clear the obstacle.

As one of these heating systems, small smudge pots were used to provide open flame heating to sections of the rails. They are oil-filled and lit by hand much like an oil lamp using a wick to draw up the fuel to the top of the unit.

Next, open flame gas was used to deliver gas along the 30-foot section of rail that needs to be heated. As open flame is somewhat dangerous, and expending vast amount of gas was expensive, the rail roads moved to new sources of heating the rails.

Another common type of switch heater used is an electric resistive heating element that is attached along the rail for the 30 feet of the switch. Within a single switch, you would have two 30-foot long elements pulling 300 watts per foot at 480-volt alternating current (VAC) using 90 amps per phase. Also needed in this system are several smaller heating resistive units called crib heaters which add to the total load of the system. This system depends on thermal transfer from the outer element across an air gap and into the rail.

Hot air blowers are also used to heat railroad tracks. When used, these units use a blower to push air into a duct system and deliver air to the rail bed. The air is heated by means of either gas fired burners of passing the air over electric restive elements. The combined amperage of the blower motor and the heat source makes these units the most expensive units to operate in the field.

The present invention intends to address the aforementioned issues. In doing so, the present invention uses a magnetic inductive heating coil to introduce heat directly into the core of the rail with reduced levels of electrical energy needed to create higher levels of heat into the rail. Lab Test using 120 VAC has used as little as 5 amps to heat the rail to 220 degrees well above the 98 degrees needed. Also of note, all of the above systems need to be removed from the rails when routine track maintenance is conducted as the equipment used will damage the parts if left in place. This will not be the case with the new inductive heating heads. These small rugged coils of the present invention will be affixed to the rail in a manner that the rail maintenance equipment will not effect as the equipment passes over the area they are installed. By having multiple standalone heads, should one fail, the others will continue to operate unlike the Calrod system. In contrast, when one of the Calrod elements burn out or fail, the entire 30-foot section fails; thus shutting down the switch for rail traffic.

The inductive heads can be attached on the side of the rail or the underside of the rail. Lab testing has shown how rapid the rail is heated, given several power level settings on the equipment. The coils within each of the heads may be potted to ensure it will remain waterproof and vibration resistant.

The Inductive Heating System of the present invention will comprise multiple heating heads (depending on the size of the rail road switch) wired back to a central control panel located beside the tracks. Within the control cabinet will be the electrical power fusing, control relays, GFI protection unit, snow-detectors, thermostat, and a small PLC unit to allow for system operational programming.

The technology introduced through the present invention can produce 1800 watts at 120V single phase directly into an eleven-inch section of the rail with zero heat loss. This means that the heads will be placed at various intervals along the section of rail that needs to be heated. As the heat is created from within the rail, it will migrate down between the individual heads to create uniform heating above the 98 degrees needed.

The magnetic induction technology was first developed in the 1980's but is now available in a size that is usable for Rail Heaters. The heating heads would be quickly install to the rail by means of a clamping device, installed between the rail ties.

The present invention functions through a variety of controls. The control unit shall be housed in a free standing stainless-steel weather proof enclosure of sufficient size as to accommodate: 1. Power disconnects, fusing and voltage filter; 2. Power supply section with outs for up to 30 field induction heads. This can be accomplished in two versions, a single large power I generator or a rack of individual cards, one for each head. The overall system pricing can be held low with the use of "Off the Self" control cards that are now being produced for magnetic induction cooking hotplates; 3. A small PLC shall be installed to govern the system total performance in the field. This unit will issue instructions to the control cards and power supply to control the amperage sent to the induction heads. This will allow for the optimum electrical power saving given weather and or train conditions; 4. Rail temperature sending units shall supply the PLC with data regarding rail overall temperature; 5. An external thermal temperature sensing unit will supply the PLC the ambient temperature so that the system will know when freezing conditions are present; 6. Two external snow detection units shall be used to detect when snow is present. One located above the control cabinet and one at the track bed to detect when snow or ice is dropped by passing trains; 7. A GFI device will be installed to ensure that any field short is detected for safety shutdown reasons; 8. An internal cabinet ambient temperature control unit shall be installed to keep the control components at designed performance levels in below freezing weather events; 9. System contactors, relays, and drivers shall be used for induction head control.

When considering the programming unit of the present invention, the PLC unit will activate the induction heads and power the total array creating heat within the rails until the system track temperature set point (adjustable) is reached. At this point, the heads will shut off and the rail temperature will begin to drop through a dead band (adjustable) until the lower temperature threshold point is reached. The PLC will then repower the induction head and take it to the rail temperature set point again. This process will continue as long as the snow detectors are indicating snow is present. An optional time window for heating the rail after the snow detectors have dropped out will be available to ensure the track bed is free of snow and ice. In this manner, the overall system heads will pulse on and off to reduce the total system electrical amperage to the lowest level possible.

Should the PLC detect that a passing train over the induction heads has drastically reduced the rail temperature by means of the air turbulence generated by the train or the snow and ice dropped; the unit will respond by raising the wattage delivered to each head of a short time to restore the rail temperature set point. In this way the unit is self-adjusting to not only control the total system amperage, but also ensure the track bed and switch are ready for the next train.

The overall system control system shall have the capability to be viewed from a remote location via a cellular modem connection to the internet. This interface shall allow for the monitoring of the equipment, system diagnostics, and or changing the system programming from that remote point.

The wiring of the individual heads shall be accomplished by means of flexible armored cables fitted with quick disconnects that attach to two parallel conduit arrays that lay to the side of the rails in the ballast stone. There shall be a small junction box for each side of the typical railroad switch. From the junction box, the wires will pass into a wire tray and on to the induction coils. A wire tray will be designed to be a rigged device so that the wire tray can be separated if components need to be replaced. Since heat is not transferred from the induction head to the rail, the safety of railroad personnel is guaranteed. Unlike existing system now used in the Rail Road Industry, the induction heads will not be required to be removed from the rails and then put back in place when a Track Tamper Machine passes over the switch for normal track maintenance.

The induction heads shall be attached to the rail by means of a quick connection rail clamping unit. The clamp will require no changes to the rail in the field and shall allow the head to be moved to multiple locations in the switch bed to accommodate variances in track layout. The heads can be used on the outer body of the main rails or can be placed at the "Moving Switch Point" to maximize overall system efficiency. The body of the head shall be constructed of fiberglass with the induction coil potted in a non-conductive binder to ensure that track and train vibrations do not affect the performance. The potting of the coil will also make the head water proof and form an insulation barrier to guard against electrical shorting in the field wiring.

The "crib" area is referred to as the area between the ties that the linkage arms are located that attach to the Switch Motor that move the rails in the switch. Should this area become impacted with snow and ice the linkage arms are prevented from movement and the switch is disabled. This area can be heated by use of an induction head attached to a steel plate that covers the area. Again, all the same features and control benefits of the main induction heads are relative to this section of the system.

This program has been mandated by the Federal Government to track train movements across all railroads in real time. To accomplish this, Railroad Signal Systems use "Track Circuits" and inject low level voltage into the track that is not allowed to be affected by other systems or hardware. As each of the induction heads are insulated from the rail by means of its insulated wire and disconnect plug, the system will not allow for conductive shorting of the rails. The heating systems that are now used in the industry often provide ground paths through the metal parts and or cables which defeat "track circuits" used in modern "Positive Train Control signaled territory".

On all Rail Road Bridges across the industry, Lift Rail Joints are required for the parting of the rails when the bridge is opened. During winter months, snow and ice fall into the pockets when the bridge is opened. As the bridge is closed back up if this snow and ice prevents the rail from reseating, rail traffic is held up until the pockets can be cleaned out and the rails reseated. By clamping the small induction head to the pocket plate steel on the bridge, the pockets can now he heated in the same manner as rail switches and the pockets will be self-cleaning at the site.

In order to function, low frequency "E" heads require a large mass of steel configured into what is typically shaped like the letter E. It is necessary to construct these units out of a large mass of steel (up to eight inches thick) due to the low power needed to establish enough thermal heat to be effective for melting snow and ice in the track bed. In order to accommodate the bulk of the E Head, large amounts of ballast stone are needed to be removed from between the track ties to fit the heads into place. As track maintenance machines called "Tampers" run over the area where the heads are located, the tamper will dump ballast stone back into the area where the heads are located. Should a heavy fright trail pass over the heads, the weight of the trains will press down on the rail/E head and is likely to damage the unit between the rail and the stone. Also, the bulk of the E Heads will not lend it to be mounted on the side of the rails in switching areas. For this reason, this technology has not been used in heavy freight traffic lines in the USA.

The E Heads are used on light commuter lines in Europe as long as it is understood that additional effort is undertaken to keep the ballast stone removed from under the heads. For these reasons the small, thin profile of the powerful magnetic inductive coils described in this Patent offer superior performance and flexibility to the rail industry.

DETAIL DESCRIPTIONS OF THE INVENTION

All illustrations of the drawings are for the purpose of describing selected versions of the present invention and are not intended to limit the scope of the present invention.

The present invention introduces a heating head that aids the process of melting snow or ice that accumulates on a train track rail during cold weather conditions. By utilizing the present invention, a large amount of heat can be generated within a short time so that safe operating conditions are consistently maintained.

Figure 1:
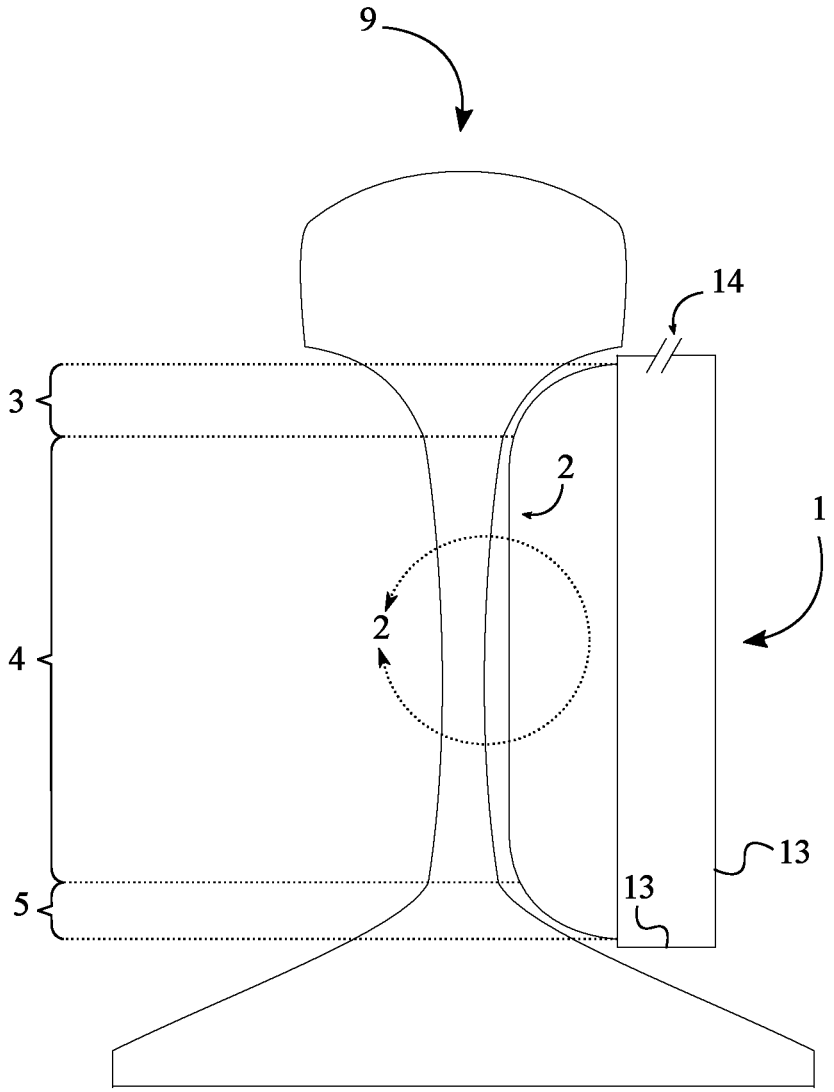
FIG. 1 is a schematic side view of the present invention being used with the at least one train track rail.
Figure 3:
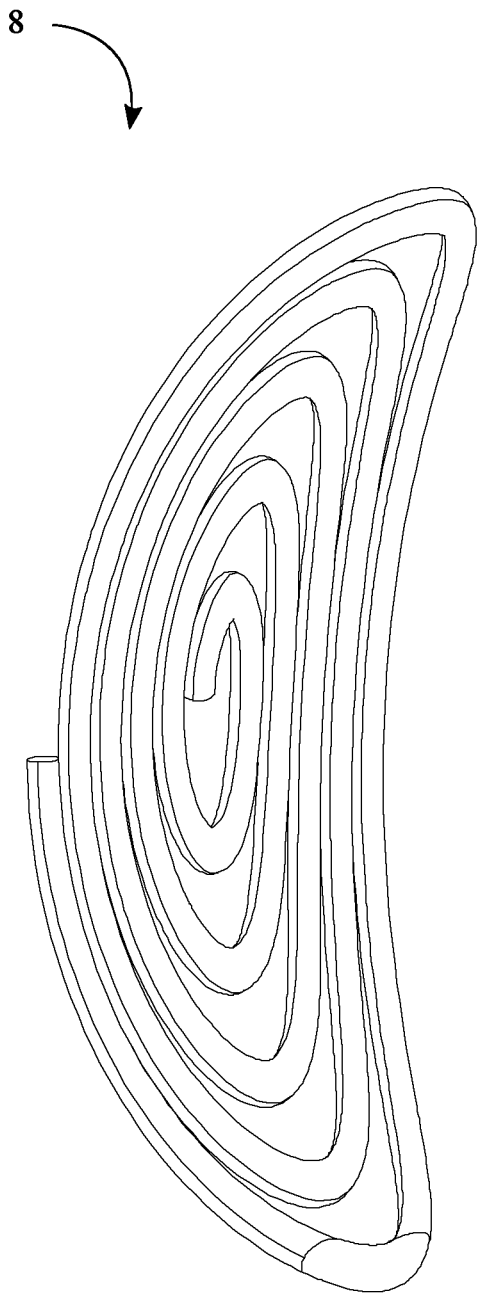
FIG. 3 is a perspective view of the induction coil, wherein the oblong, concave shape is illustrated for the induction coil.
Figure 4:
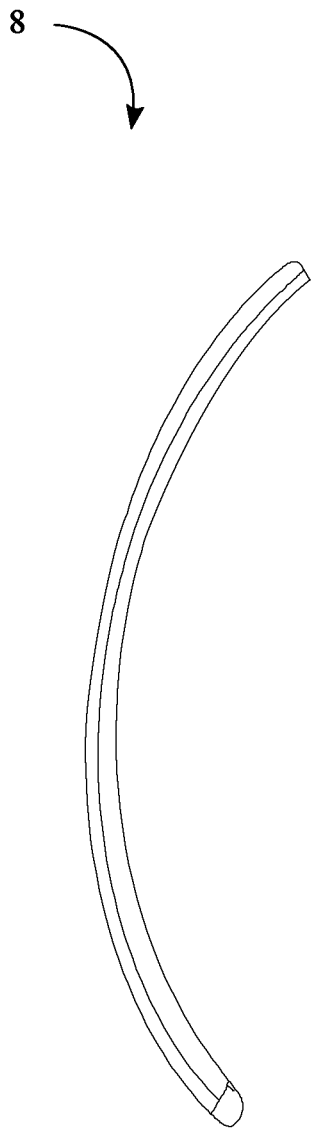
FIG. 4 is a side view of the induction coil, wherein the concave shape is illustrated for the induction coil.
Figure 5:
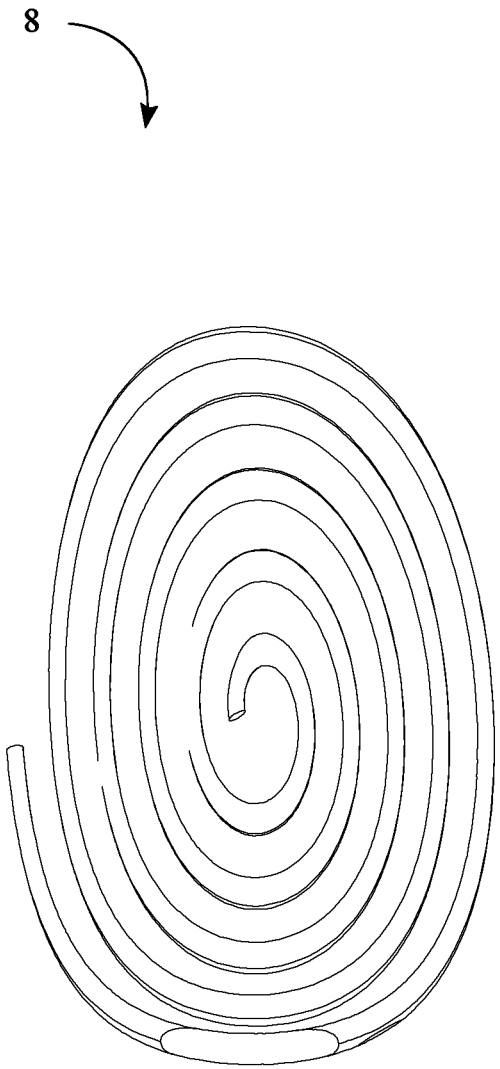
FIG. 5 is a front view of the induction coil, wherein the oblong shape is illustrated for the induction coil.

To achieve the preferred functionalities, the present invention comprises a vented enclosure 1 and an induction coil 8. As illustrated in FIG. 1, the vented enclosure 1 is used to position the induction coil 8 along an at least one train track rail 9. In the preferred embodiment of the present invention, the vented enclosure 1 is made of fiberglass. However, other comparable material can be used in other embodiments of the present invention. The induction coil 8 is used to induce eddy current magnetic fields on the at least one train track rail 9 so that the molecules of the at least one train track rail 9 are excited which leads to generation of heat. Preferably, the induction coil 8 is electrically connected to an external power supply which can be, but it not limited to, a 120-Volt alternating current (AC) power supply. However, a different power supply can be used in other embodiments of the present invention. When being used with the at least one train track rail 9, the induction coil 8 is positioned within the vented enclosure 1 and across a rail-bracing wall 2 of the vented enclosure 1. When in use, the rail-bracing wall 2 will be positioned adjacent the at least one train track rail 9. As illustrated in FIG. 3-5, to emit a maximum amount of eddy current magnetic fields onto the at least one train track rail 9, an oblong, concave shape of the induction coil 8 is configured to conform a contour of the rail-bracing wall 2. In other words, the oblong, concave shape of the induction coil 8 ensures that a large surface area of the at least one train track rail 9 is induced with the eddy current magnetic fields generated by the induction coil 8. The multi-dimensional eddy current magnetic field induced by the induction coil 8 is considerably stronger than a standard single dimensional magnetic field. Thus, a larger surface area of the at least one train track rail 9 is heated.

For maximum efficiency, both the induction coil 8 and the rail-bracing wall 2 need to correspond to a shape of the at least one train track rail 9. As seen in FIG. 1, to correspond to the shape of the at least one train track rail 9, the rail-bracing wall 2 comprises a head-bracing portion 3, a web-bracing portion 4, and a foot-bracing portion 5 that are positioned adjacent a lateral portion 10 of the at least one train track rail 9. More specifically, the shape of the rail-bracing wall 2 ensures that the rail-bracing wall 2 is positioned adjacent the lateral portion 10 of the at least one train track rail 9. To do so, the head-bracing portion 3 is positioned adjacent to the web-bracing portion 4. Moreover, the foot-bracing portion 5 is positioned adjacent to the web-bracing portion 4 opposite to the head-bracing portion 3. For maximum efficiency, the oblong, concave shape of the induction coil 8 spans from the head-bracing portion 3, across the web-bracing portion 4, and to the foot-bracing portion 5. Thus, the eddy current magnetic field induced by the induction coil 8 can saturate a large surface area of the at least one train track rail 9.

Figure 2:
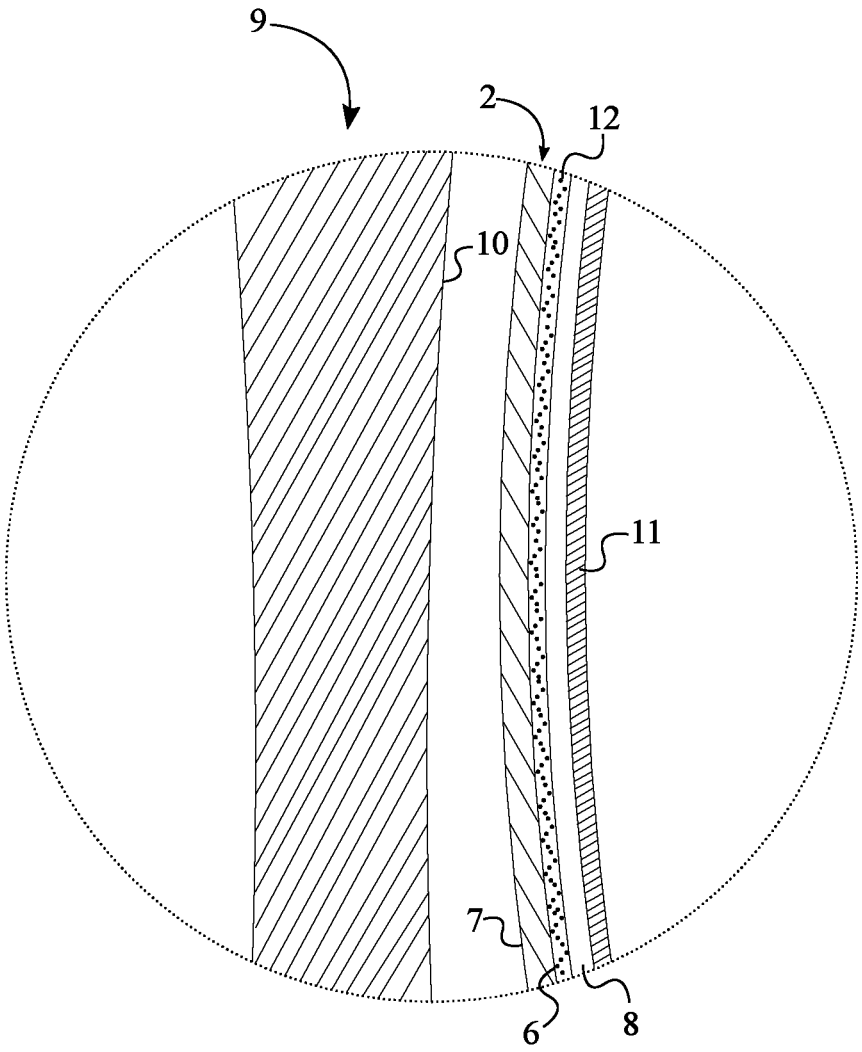
FIG. 2 is a detailed view taken about circle 2 in FIG. 1, which illustrates the rail-bracing wall, the electrically insulative potting, the induction coil, and the eddy current deflecting magnetic shield.

As illustrated in FIG. 2, to accommodate the oblong, concave shape of the induction coil 8 and be positioned adjacent the lateral portion 10, the rail-bracing wall 2 further comprises a concave interior surface 6 and a convex exterior surface 7. Thus, the oblong, concave shape of the induction coil 8 can span across the concave interior surface 6. When the present invention is being used with the at least one train track rail 9, the convex exterior surface 7 is positioned adjacent the lateral portion 10.

As discussed before, eddy current magnetic fields induced by the induction coil 8 are used to generate heat within the at least one train track rail 9 that melts any accumulated snow or ice. When the AC current supply is connected to the induction coil 8, a time-varying magnetic field within the induction coil 8 induces eddy current magnetic fields on the at least one train track rail 9. The time-varying eddy current magnetic field prompts the molecules within the at least one train track rail 9 to align polarities. The oscillations of the molecules within the magnetic field generates heat which then spreads along the at least one train track rail 9. The heat results in the removal of snow or ice accumulated on the at least one train track rail 9. To maximize eddy current magnetic field induction on the at least one train track rail 9, the present invention further comprises an eddy current deflecting magnetic shield 11 that orients the time-varying magnetic field towards the at least one train track rail 9. To do so, the eddy current deflecting magnetic shield 11 is mounted within the vented enclosure 1 so that the induction coil 8 is positioned in between the rail-bracing wall 2 and the eddy current deflecting magnetic shield 11. A shape of the eddy current deflecting magnetic shield 11 is configured to copy the oblong, concave shape of the induction coil 8. Therefore, the eddy current deflecting magnetic shield 11 can be mounted onto and across the induction coil 8 opposite the concave interior surface 6 as seen in FIG. 2.

As further illustrated in FIG. 2, the present invention further comprises a thin layer of electrically-insulative potting 12 which is used to mount the induction coil 8 across the rail-bracing wall 2. In the preferred embodiment of the present invention, the thin layer of electrically-insulative potting 12 is a fiberglass resin. However, the thin layer of electrically-insulative potting 12 can differ in other embodiments of the present invention. To operate at higher temperatures, the induction coil 8 of the preferred embodiment is configured with an enamel coating.

As previously mentioned, the vented enclosure 1 aids in the process of positioning the induction coil 8 adjacent to the at least one train track rail 9. In addition to the rail-bracing wall 2, the vented enclosure 1 further comprises a plurality of remaining walls 13 and at least one louver 14 as seen in FIG. 1. The plurality of remaining walls 13 determines the overall shape of the vented enclosure 1. The at least one louver 14, which is integrated into the plurality of remaining walls 13, maintains air circulation between the interior of the vented enclosure 1 and the external atmosphere.

When the present invention is being used, the assembly of the induction coil 8 and the vented enclosure 1 is mounted adjacent the lateral portion 10 of the at least one train track rail 9. The head-bracing portion 3, the web-bracing portion 4, the foot-bracing portion 5, and the convex exterior surface 7 allows the vented enclosure 1 to be positioned adjacent the lateral portion 10 of the at least one train track rail 9. To induct eddy current magnetic fields onto the head, web, and the foot of the at least one train track rail 9, the induction coil 8 is pressed against the concave interior surface 6. The oblong, concave shape allows the coil to be pressed against the concave interior surface 6.

Furthermore, the concave, oblong shape effectively inducts eddy current magnetic fields onto the head, the web, and the foot of the at least one train track rail 9. Thus, more heat is generated within the at least one train track rail 9 by the activation of molecules of the material. In the preferred embodiment of the present invention, when the induction coil 8 is connected to the 120-Volt AC power supply, a time-varying magnetic field is generated within the induction coil 8. As a result, eddy current magnetic fields are induced on the at least one train track rail 9. Since, the eddy current magnetic fields are induced in a larger surface area of the at least one train track rail 9, more heat is generated. In the preferred embodiment of the present invention, the temperature of the heat can be between 360-fahrenheit and 460-fahrenheit. In another embodiment of the present invention, a temperature sensor can be positioned within the vented enclosure 1 so that overheating is prevented. Moreover, the power supply can be connected to the rail heating head through a power supply card that comprises a power conditioning unit, a control board, and a frequency generator. The power conditioning unit can be used to prevent electrical failures and modulate the power supply to the rail heating head. The frequency generator can be used to generate varying frequencies so that different heat levels can be generated within the at least one train track rail 9. On the other hand, the control board can be used to control the overall current flow to the induction coil 8.

Although the invention has been explained in relation to its preferred embodiment, it is to be understood that many other possible modifications and variations can be made without departing from the spirit and scope of the invention as hereinafter claimed.

What is claimed is:

1. A rail heating head comprises:
a vented enclosure;
an induction coil;
the induction coil being positioned within the vented enclosure;
the induction coil being mounted across a rail-bracing wall of the vented enclosure; and
an oblong, concave shape of the induction coil being configured to conform to a contour of the rail-bracing wall.

2. The rail heating head as claimed in claim 1 comprises:
the rail-bracing wall comprises a head-bracing portion, a web-bracing portion, and a foot-bracing portion, wherein the head-bracing portion, the web-bracing portion, and the foot bracing portion are positioned adjacent a lateral portion of an at least one train track rail;
the head-bracing portion being positioned adjacent to the web-bracing portion;
the foot-bracing portion being positioned adjacent to the web-bracing portion, opposite to the head-bracing portion; and
the oblong, concave shape of the induction coil spanning from the head-bracing portion, across the web-bracing portion, and to the foot bracing portion.

3. The rail heating head as claimed in claim 1 comprises:
the rail-bracing wall comprises a concave interior surface and a convex exterior surface, wherein the convex exterior surface is positioned adjacent a lateral portion of an at least one train track rail; and
the oblong, concave shape of the induction coil spanning across the concave interior surface.

4. The rail heating head as claimed in claim 1 comprises:
an eddy current deflecting magnetic shield;
the eddy current deflecting magnetic shield being mounted within the vented enclosure;
the induction coil being positioned in between the rail-bracing wall and the eddy current deflecting magnetic shield device; and
a shape of the eddy current deflecting magnetic shield being configured to copy the oblong, concave shape of the induction coil.

5. The rail heating head as claimed in claim 4, wherein the eddy current deflecting magnetic shield being mounted onto and across the induction coil, opposite of a concave interior surface of the rail-bracing wall.

6. The rail heating head as claimed in claim 1, wherein the vented enclosure is made of a fiberglass.

7. The rail heating head as claimed in claim 1 comprises:
a thin layer of electrically-insulative potting; and
the induction coil being mounted across the rail-bracing wall by the thin layer of electrically-insulative potting.

8. The rail heating head as claimed in claim 7, wherein the thin layer of electrically-insulative potting is a fiberglass resin.

9. The rail heating head as claimed in claim 1, wherein the induction coil is configured with an enamel coating.

10. The rail heating head as claimed in claim 1 comprises:
the vented enclosure comprises a plurality of remaining walls and at least one louver;
the plurality of remaining walls being positioned adjacent to the rail-bracing wall; and
the at least one louver being integrated into the plurality of remaining walls.

11. A rail heating head comprises:
a vented enclosure;
an induction coil;
an eddy current deflecting magnetic shield;
the induction coil being positioned within the vented enclosure;
the induction coil being mounted across a rail-bracing wall of the vented enclosure;
an oblong, concave shape of the induction coil being configured to conform to a contour of the rail-bracing wall;
the eddy current deflecting magnetic shield being mounted within the vented enclosure;
the induction coil being positioned in between the rail-bracing wall and the eddy current deflecting magnetic shield device;
a shape of the eddy current deflecting magnetic shield being configured to copy the oblong, concave shape of the induction coil; and
the eddy current deflecting magnetic shield being mounted onto and across the induction coil, opposite of a concave interior surface of the rail-bracing wall.

12. The rail heating head as claimed in claim 11 comprises:
the rail-bracing wall comprises a head-bracing portion, a web-bracing portion, and a foot-bracing portion, wherein the head-bracing portion, the web-bracing portion, and the foot bracing portion are positioned adjacent a lateral portion of an at least one train track rail;
the head-bracing portion being positioned adjacent to the web-bracing portion;
the foot-bracing portion being positioned adjacent to the web-bracing portion, opposite to the head-bracing portion; and
the oblong, concave shape of the induction coil spanning from the head-bracing portion, across the web-bracing portion, and to the foot bracing portion.

13. The rail heating head as claimed in claim 11 comprises:
the rail-bracing wall comprises a concave interior surface and a convex exterior surface, wherein the convex exterior surface is positioned adjacent a lateral portion of an at least one train track rail; and
the oblong, concave shape of the induction coil spanning across the concave interior surface.

14. The rail heating head as claimed in claim 11 comprises:
a thin layer of electrically-insulative potting, wherein the thin layer of electrically-insulative potting is a fiberglass resin; and
the induction coil being mounted across the rail-bracing wall by the thin layer of electrically-insulative potting.

15. The rail heating head as claimed in claim 11, wherein the induction coil is configured with an enamel coating.

16. The rail heating head as claimed in claim 11 comprises:

the vented enclosure comprises a plurality of remaining walls and at least one louver;

the plurality of remaining walls being positioned adjacent to the rail-bracing wall; and the at least one louver being integrated into the plurality of remaining walls.

* * * * *